US007070897B2

(12) United States Patent
Imafuku et al.

(10) Patent No.: US 7,070,897 B2
(45) Date of Patent: Jul. 4, 2006

(54) DEVELOPER FOR USE IN ELECTROPHOTOGRAPHY AND METHOD AND APPARATUS FOR IMAGE FORMATION

(75) Inventors: Tatsuo Imafuku, Nara (JP); Junichi Saito, Nara (JP); Takahiro Bito, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/282,578

(22) Filed: Oct. 29, 2002

(65) Prior Publication Data

US 2003/0082471 A1 May 1, 2003

(30) Foreign Application Priority Data

Oct. 29, 2001 (JP) ..... 2001-331130

(51) Int. Cl.
*G03G 9/113* (2006.01)

(52) U.S. Cl. ..... 430/108.6; 430/111.35; 430/111.4

(58) Field of Classification Search ..... 430/111.35, 430/111.33, 111.32, 108.6, 108.1, 111.4, 430/111.34
See application file for complete search history.

(56) References Cited

U.S. PATENT DOCUMENTS

| | | | | |
|---|---|---|---|---|
| 4,822,708 | A * | 4/1989 | Machida et al. | 430/111.32 |
| 5,260,190 | A * | 11/1993 | Shiraishi et al. | 435/6 |
| 5,500,319 | A * | 3/1996 | Funato et al. | 430/109.1 |
| 6,071,663 | A * | 6/2000 | Matsuda et al. | 430/111.35 |
| 6,472,118 | B1 * | 10/2002 | Yamaguchi et al. | 430/111.35 |

FOREIGN PATENT DOCUMENTS

| | | |
|---|---|---|
| JP | 53-110836 | 9/1978 |
| JP | 56142540 A * | 11/1981 |
| JP | 61-140951 | 6/1986 |
| JP | 62-121463 | 6/1987 |
| JP | 11-184147 | 7/1989 |
| JP | 05-072815 | 3/1993 |
| JP | 05-134467 | 5/1993 |
| JP | 05-204189 | 8/1993 |
| JP | 60-019156 | 1/1995 |
| JP | 07-056395 | 3/1995 |
| JP | 07-114220 | 5/1995 |
| JP | 09-304972 | 11/1997 |
| JP | 11-242361 | 9/1999 |
| JP | 11-265091 | 9/1999 |
| JP | 11-327215 | 11/1999 |
| JP | 2001-281934 | 10/2001 |

OTHER PUBLICATIONS

Borsenberger, Paul M. et al. Organic Photoreceptors for Imaging Systems. New York: Marcel-Dekker, Inc. (1993) pp. 6-17.*
Diamond, Arthur S. (ed.) Handbook of Imaging Materials. New York: Marcel-Dekker, Inc. (1991) pp. 169-170.*
Machine translation of JP 11-265091.*
Klein, Cornelius et al. Manual of Mineralogy. New York: John Wiley & Sons. (1985) p. 310.*
Copy of First Chinese Office Action dated Jan. 7, 2005 (along with English translation thereof).

* cited by examiner

*Primary Examiner*—Christopher Rodee
(74) *Attorney, Agent, or Firm*—Edwards Angell Palmer & Dodge LLP; David G. Conlin; Mark D. Russett

(57) ABSTRACT

In the two-component developer for use in electrophotography containing a toner and a carrier, said toner contains a magnetic powder as an external additive, said carrier is a resin coated magnetic carrier of 6.0 to 8.0 in true specific gravity, and the coating resin is a silicone based resin containing a crosslinking agent having phenyl groups and an aminosilane coupling agent. The crossliking agent in the coating resin for the carrier has phenyl groups in a content ratio of 0.2 to 15% by number.

6 Claims, 2 Drawing Sheets

Fig. 2

| | Physical properties of carrier | | | | | Physical properties of toner | Evaluation results | | | | | | | |
|---|---|---|---|---|---|---|---|---|---|---|---|---|---|---|
| | True specific gravity [g/cc] | Phenyl group [% by number] | Aminosilane coupling agent [wt%] | Amount of silicone resin [wt%] | Particle size [μm] | Amount of magnetite [wt%] | Initial | | 20K | | Dotted image | Environmental variation of charge | Rise of charging | Overall evaluation |
| | | | | | | | Image density | Fogging | Image density | Fogging | | | | |
| | 6 0-8 0 | 1-5 | 14-18 | 7-8 | 40-80 | 1-3 | 5 | 5 | 5 | 5 | 5 | 5 | 5 | 5 0 |
| Example 1 | 7 0 | 3.0 | 16 | 7.5 | 60 | 2.0 | 5 | 5 | 5 | 5 | 5 | 5 | 5 | 5.0 |
| Example 2 | 4 5 | 3.0 | 16 | 7.5 | 60 | 2.0 | 1 | 2 | 1 | 2 | 5 | 5 | 5 | 3.0 |
| Example 3 | 6 5 | 3 0 | 16 | 7.5 | 60 | 2.0 | 3 | 3 | 3 | 3 | 5 | 5 | 5 | 3.9 |
| Example 4 | 7.5 | 3 0 | 16 | 7.5 | 60 | 2.0 | 4 | 4 | 5 | 5 | 3 | 5 | 5 | 4 4 |
| Example 5 | 8 5 | 3 0 | 16 | 7.5 | 60 | 2.0 | 2 | 2 | 1 | 1 | 2 | 5 | 5 | 2 6 |
| Example 6 | 7 0 | 0.5 | 16 | 7.5 | 60 | 2.0 | 5 | 5 | 5 | 5 | 5 | 1 | 5 | 4 4 |
| Example 7 | 7 0 | 1 5 | 16 | 7.5 | 60 | 2.0 | 5 | 5 | 5 | 5 | 5 | 3 | 5 | 4 7 |
| Example 8 | 7.0 | 4 5 | 16 | 7.5 | 60 | 2.0 | 5 | 5 | 3 | 3 | 5 | 5 | 5 | 4 4 |
| Example 9 | 7.0 | 6 | 16 | 7.5 | 60 | 2.0 | 5 | 5 | 2 | 2 | 5 | 5 | 5 | 4 1 |
| Example 10 | 7 0 | 3.0 | 13 | 7.5 | 60 | 2.0 | 5 | 3 | 5 | 3 | 5 | 5 | 2 | 4.0 |
| Example 11 | 7.0 | 3 0 | 15 | 7.5 | 60 | 2.0 | 5 | 4 | 5 | 4 | 5 | 5 | 3 | 4.4 |
| Example 12 | 7 0 | 3 0 | 17 | 7.5 | 60 | 2.0 | 3 | 5 | 3 | 5 | 5 | 5 | 5 | 4.4 |
| Example 13 | 7.0 | 3 0 | 19 | 7.5 | 60 | 2.0 | 2 | 5 | 2 | 5 | 5 | 5 | 5 | 4 1 |
| Example 14 | 7 0 | 3.0 | 16 | 6 8 | 60 | 2.0 | 5 | 5 | 2 | 2 | 5 | 5 | 5 | 4 1 |
| Example 15 | 7.0 | 3.0 | 16 | 7.2 | 60 | 2.0 | 5 | 5 | 3 | 3 | 5 | 5 | 5 | 4 4 |
| Example 16 | 7 0 | 3.0 | 16 | 7.8 | 60 | 2.0 | 3 | 5 | 3 | 5 | 5 | 5 | 5 | 4 4 |
| Example 17 | 7 0 | 3 0 | 16 | 8.2 | 60 | 2.0 | 2 | 2 | 2 | 2 | 5 | 5 | 5 | 3 3 |
| Example 18 | 7 0 | 3 0 | 16 | 7.5 | 30 | 2.0 | 5 | 5 | 2 | 2 | 5 | 5 | 3 | 3 9 |
| Example 19 | 7.0 | 3 0 | 16 | 7.5 | 50 | 2.0 | 5 | 5 | 3 | 3 | 5 | 5 | 4 | 4.3 |
| Example 20 | 7.0 | 3 0 | 16 | 7.5 | 70 | 2.0 | 5 | 5 | 5 | 5 | 3 | 5 | 4 | 4.6 |
| Example 21 | 7 0 | 3.0 | 16 | 7.5 | 90 | 2.0 | 5 | 5 | 5 | 5 | 2 | 5 | 3 | 4 3 |
| Example 22 | 7 0 | 3.0 | 16 | 7.5 | 60 | 0.5 | 2 | 5 | 2 | 5 | 5 | 5 | 5 | 4.1 |
| Example 23 | 7.0 | 3.0 | 16 | 7.5 | 60 | 1.5 | 3 | 5 | 3 | 5 | 5 | 5 | 5 | 4 4 |
| Example 24 | 7 0 | 3.0 | 16 | 7.5 | 60 | 2.5 | 5 | 3 | 5 | 3 | 5 | 4 | 4 | 4 1 |
| Example 25 | 7.0 | 3 0 | 16 | 7.5 | 60 | 3.5 | 5 | 2 | 5 | 2 | 2 | 3 | 3 | 3.1 |

DEVELOPER FOR USE IN ELECTROPHOTOGRAPHY AND METHOD AND APPARATUS FOR IMAGE FORMATION

BACKGROUND OF THE INVENTION

1. Field of the Invention

The present invention relates to a developer for use in electrophotography and a method and an apparatus for image formation, in particular, relates to a carrier and a toner for use in such a image formation method as electrophotography, a developer which uses the toner and carrier, a method for image formation which method uses the toner and developer, and an apparatus for image formation which apparatus uses the toner and developer.

2. Description of the Related Art

A two-component developer for use in electrophotography is composed of a toner and a carrier, and the carrier is a conveying substance which is mixed with the toner under stirring in a development box to transfer the charge to the toner, and delivers the charged toner to an electrostatic latent image on a photoreceptor to form a toner image. The carrier is left on a magnet roll and then returns to the development box where the carrier is again mixed with the toner under stirring to follow repeatedly the same process as mentioned above. Accordingly, the carrier is required to acquire and maintain the desired charging characteristics in relation to the toner in any environment.

Conventional developers have two problems that are caused by the mutual collision of the carrier particles through stirring and by the friction between the development box wall and the carrier particles: One is the problem that the toner fuses and sticks to the carrier particle surface and hence the toner is made to be spent; and the other is the problem that the resistance of the carrier is degraded by the peeling off and elimination of the coated resin layer on the carrier particle, inducing the degraded images (image density deficiency, image fogging defect, and the like) after plate wear, as compared with the images in the earlier stages of the printing. The degradation of the developer (carrier) due to stirring as well as the environmental variation at the time of plate wear induces a reduction of the charge when the ambient temperature and humidity are high, resulting in toner scattering and image fogging defect. On the other hand, as matters now stand, when the ambient temperature and humidity are low, charge increases to cause a problem of image density deficiency, eventually resulting in a reduced life of the developer. In particular, as the carrier for use in full color printing, as compared to the printing with the conventional copying machines, printers, and the like, the solid printing areas are larger than the character printing areas so that the toner quantity transferred to the photoreceptor becomes large and hence the further higher durability is required to the carrier.

As measures to overcome such toner spent and the degradation of the charge due to the environmental variation at the time of plate wear, a variety of methods have been proposed for coating the carrier particle with resins. No satisfactory method, however, has been developed yet. For example, the carriers coated with the silicone based resins and the fluororesins have low critical surface tension, so that there scarcely tends to occur the spent state in which the toner fuses and sticks onto the surface of the carrier particle, resulting in elongation of the life of the developer. On the other hand, the carriers just mentioned above are low in the ability of charging the toner and carrier so that the toner scattering frequently occurs to contaminate the interior of the printing machine and to eventually induce the defects on the image, leading to the overall evaluation that the developer is still short in life.

The use of the silane coupling agent has been proposed (see Japanese Patent Laid-Open No. 60-19156), as the measures to overcome the image degradation (image density deficiency, image fogging defect, and the like) due to the peeling off and elimination of the coated layer on the surface of carrier particle caused by the mutual collision of the carrier particles through stirring and by the friction between the development box wall and the carrier particles. The use of the silane coupling agent improves the coated layer adhesion, but there is still the problem that the charge variation under the various environmental conditions causes the toner scattering and induces the image fogging.

On the other hand, there has been proposed a carrier and the like which carrier is provided with a coating layer composed of silicone resin on the surface of the carrier core processed with the silane coupling agent for the purpose of improving the adhesion between the carrier core and the silicone resin (see Japanese Patent Laid-Open No. 62-121463). This carrier, however, has no aminosilane coupling agent component having effective amino groups on the outermost surface of the carrier, and hence the carrier has no sufficient charging ability in relation to the toner negative in electrode property, resulting in the toner scattering to occur at the time of plate wear, namely still leading to unsatisfactory results.

Recently, there has been described a carrier in which the resin layer containing the aminosilane coupling agent comprises the outermost layer and intermediate layer different from each other in resin composition or in additive (see Japanese Patent Laid-Open No. 5-72815, and Japanese Patent Laid-Open No. 5-134467). Furthermore, there has been described a carrier in which a concentration gradient is provided along the thickness direction of the silicone resin layer with respect to the silane coupling agent and the like (see Japanese Patent Laid-Open No. 5-204189). In these carriers, the individual constituent components are not homogeneous in the resin layer of the carrier, and hence, in particular in the silicone resin coated carrier, there occurs the time variation in the carrier consititution during being allowed to stand in such a way that the outermost layer and the intermediate layer of the resin layer deviate from each other in curing state. Hence the early charging property as prepared in relation to the toner and the charging property after an elapse of time in relation to the toner differ largely, the carrier containing a conductive material that decreases in charge with high humidity, and furthermore, when the peeling off and elimination of the resin layers occur at the time of plate wear, the resistance of the carrier alters largely, so that these carriers cannot be said to be satisfactory in durability in a conclusive estimation.

In the conventional resin coated carrier as described above in which the aminosilane coupling agent is used, the content of the aminosilane coupling agent is in most cases 3 wt % or below in relation to the coated layer resin, and at most 5 wt % in relation to the resin as described in Japanese Patent Laid-Open No. 61-140951.

Nowadays, demand is increasing for the uniform reproduction of the images such as barcodes and the like having solid printing portions in large proportion and the images of the graphic designs and the like, in place of the vouchers carrying mostly characters printed by printers and the like; in particular, in full color printing and the like, the solid printing areas are larger than the character carrying areas, and accordingly the consuming amount and the feeding amount of the toner are increased. It is demanded that the toner always maintains a desired charging characteristic in the development process of electrophotography under any environmental conditions. At present, however, in light of the recent development conditions of the high amount toner consuming and feeding system, there have been obtained no satisfactory developer and carrier. In other words, in particular, the conventional toner is not yet satisfactory with respect to the rise behavior of the charging property under the conditions of high temperature and high humidity, although the conventional carrier and developer are improved in preventing the toner from being spent, in adhesion property of the coated layer of the carrier, and to some extent in the charge donating ability of the carrier to the toner through the use of the aminosilane coupling agent. At present, the carrier has no sufficient ability of charge donation to the small-sized particle toner and the high density toner for use in the high-resolution image printing, recently involving in particular large areas of solid printing, on the printers and full color machines. Hence, the carrier cannot quickly raise the charge in the toner which is fed at the time of plate wear, which means the durability of the developer is still unsatisfactory.

SUMMARY OF THE INVENTION

The silicone resin is poor in the adhesion property with the core material, and accordingly tends to be easily peeled off from the core material. In addition, the silicone resin generally has a drawback that it is mechanically weak, and the silicone resin layer is sometimes removed from the surface of the core material owing to the abrasion, exfoliation, cracking, and the like. Accordingly the developer loses the excellent characteristics to degrade the copying performance and the like, and hence the developer is not satisfactory in view of its life for use in long period of time. The above described resin coated carrier is low in charging ability as the resin alone (the saturated charge) and unsatisfactory in the charge rise property, resulting in degradation of the image quality through the fogging in the plain portions, enhanced edge effects, and the like.

An object of the present invention is to solve the above described problems and to provide a developer of a high developing ability for use in electrophotography which developer comprises a carrier which is prevented from being spent, that is, from toner film formation on the surface thereof, and moreover has such a sufficient durability that the excellent characteristics are not degraded for use over a long period time, and the toner which maintains the excellent characteristics over a long period of time, and a method and an apparatus for image formation.

The present invention is a two-component developer for use in electrophotography containing a toner and a carrier, in which said toner contains a magnetic powder as an external additive, said carrier is a resin coated magnetic carrier of 6.0 to 8.0 in true specific gravity, and the coating resin is a silicone based resin containing a crosslinking agent having phenyl groups and an aminosilane coupling agent.

In addition, the present invention is the developer for use in electrophotography, in which the crosslinking agent in the coating resin of said carrier has a phenyl group ratio of 0.2 to 15% by number.

The present invention is the developer for use in electrophotography, in which the coating resin of said carrier has a content ratio of the aminosilane coupling agent ranging from 5 to 20 wt %.

Furthermore, the present invention is the developer for use in electrophotography, in which a coating amount of the silicone based resin for the carrier core material is 7.0 to 8.0 wt % in relation to a carrier core material.

In addition, the present invention is the developer for use in electrophotography, in which a 50% average particle size based on volume of the magnetic carrier coated with the coating resin is 40 to 80 μm.

Moreover, the present invention is the developer for use in electrophotography, in which the toner is mixed with a magnetic fine powder as an external additive, and said magnetic fine powder is octahedral in shape and contains 1 to 3 wt % of magnetite having at least aminosilane groups on the surface thereof.

Furthermore, the present invention is a method for image formation in which said developer for use in electrophotography is used.

In addition, the present invention is an apparatus for image formation in which said developer for use in electrophotography is used.

BRIEF DESCRIPTION OF THE DRAWINGS

FIG. 2 is a diagram illustrating the performance evaluation results of the developers for use in electrophotography of the examples.

DETAILED DESCRIPTION OF THE PREFERRED EMBODIMENTS

Figure 1:
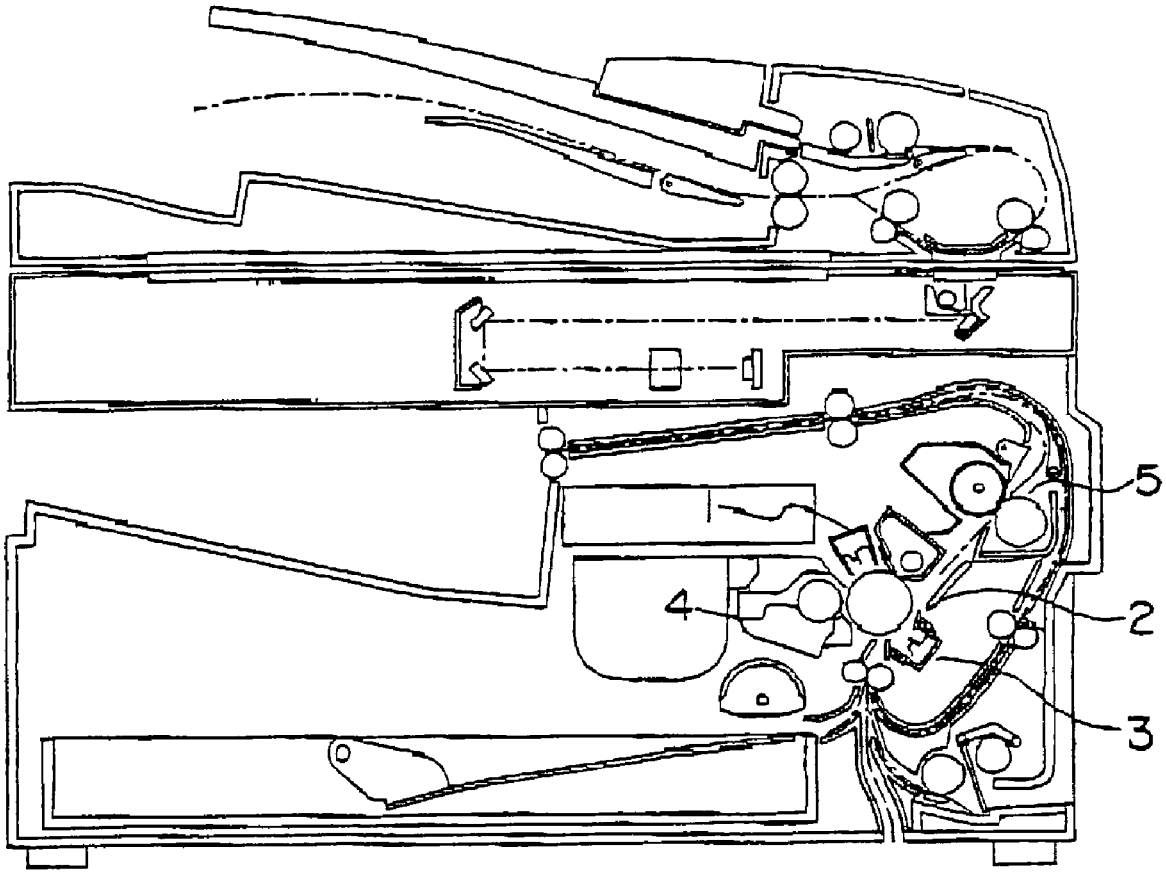
FIG. 1 is an illustrative view of the apparatus for image formation of the present invention.

Description will be made below on the embodiments of the present invention.

With reference to FIGS. 1 and 2, description will be made below on the outlines and examples of the developer for use in electrophotography and the method and apparatus for image formation of the present invention. FIG. 1 is an illustrative view of the apparatus for image formation of the present invention. FIG. 2 is a diagram illustrating the performance evaluation results of the developers for use in electrophotography of the examples.

Now, the present invention will be outlined below. The two-component developer of the present invention has a toner and a carrier. The carrier is a magnetic resin coated carrier comprising a magnetic carrier core particle that has at least a binder resin and a magnetic fine particle, and a resin coating layer provided on the surface thereof. The binder resin is a silicone based resin, and the resin coating layer contains a crosslinking agent having phenyl groups and an aminosilane coupling agent. The magnetic carrier has the 50% average particle size based on volume of 40 to 80 μm, and the true density of 6.0 to 8.0. The toner contains, as an external additive, a magnetite having the aminosilane groups or the like. In the present invention, the carrier core is coated with a silicone based resin which contains an aminosilane coupling agent and a crosslinking agent having phenyl groups. Incidentally, the conductive carbon and the like may be added to the resin for the purpose of regulating the resistance and charging property.

The following 5 types of crosslinking agents are used as the crosslinking agent for use in the silicone based resin. In the following structural formulas, R represents a methyl group, an aryl group, a phenyl group, and the derivatives of these groups, and furthermore a quadrifunctional group added with a respective type of radical.

(1) An alcohol elimination type crosslinking agent, $R—Si(OCH_3)_3$ [Chemical formula 1]

(2) An acetic acid elimination type crosslinking agent,

[Chemical formula 2]

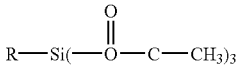

(3) An oxime elimination type crosslinking agent,

[Chemical formula 3]

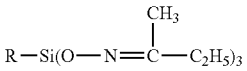

(4) An amido elimination type crosslinking agent,

[Chemical formula 4]

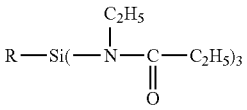

(5) An acetone elimination type crosslinking agent,

[Chemical formula 5]

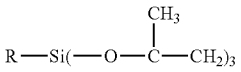

The action of these crosslinking agents for use in the silicone based resins is to react, in the presence of a catalyst and water, with the terminal OH groups of a silicone base polymer having the molecular weight of several hundreds to several ten thousands represented by the following formula,

[Chemical formula 6]

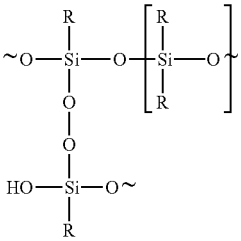

crosslinking three-dimensionally the base polymers as shown in the following formula,

[Chemical formula 7]

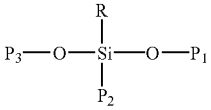

(where $P_1$, $P_2$, and $P_3$ represent respectively a methyl silicone polymer.) The crosslinking agents used in the present invention for the silicone based resin having phenyl groups are those crosslinking agents in which the R in the above shown structural formulas is a phenyl group. Among these agents, (1) the alcohol elimination type agent and (3) the oxime elimination type agent are preferably used. Furthermore, (1) the alcohol elimination type agent is most preferable in view of the reactivity and the like.

As for the content of the crosslinking agent having phenyl groups, the total number of the phenyl groups is preferably 1.0 to 5.0% by number in relation to the whole functional groups R in the whole silicone resin inclusive of the crosslinking agent. When the total number of the phenyl groups is less than 1.0% by number, the total number of the phenyl groups is so small that no effect ascribable to the phenyl groups can be obtained. When the total number of the phenyl groups exceeds 5.0% by number, the number of the phenyl groups becomes so large that the fluidity becomes degraded, and the durability of the cured film is also degraded. In the two component dry development method of electrostatic image using the carrier of the present invention, the effect of the crosslinking agent having phenyl groups is recognized in the flat and smooth coated layer of the carrier as follows: when the coating layer of the carrier is formed by crosslinking the methyl silicone base polymer, the coated layer becomes flat and smooth, in order to avoid the steric interference between the phenyl groups and the crosslinked silicone base polymer in such a way that the silicone base polymer is oriented to the carrier core and the phenyl groups are located thereon, since the phenyl groups contained as the functional groups are very bulky as compared to the methyl groups and the like. The phenyl group is highly lipophilic so that it can diminish the moisture effect on the silicone base polymer in the high temperature and high humidity environment. Consequently, the differences in the charge amount and fluidity of the developer between the environment under the atmospheric temperature and humidity and the environment under the conditions of high temperatures and high humidities are made small. On the other hand, in the coating layer of a methyl silicone polymer containing the conventional crosslinking agent having such functional groups as methyl groups and the like, the silicone base polymer forms the three-dimensionally arranged concave and convex layer, since such functional groups as methyl groups and the like are small in size and hence the silicone base polymer is nearly free from the steric hindrance of these functional groups. Consequently, when the cured coating layer is exposed to high temperatures and high humidities, the silicone base polymer is directly affected by the humidity, and hence the differences in the charge amount and fluidity of the developer between the environment under the atmospheric temperature and humidity and the environment under the conditions of high temperatures and high humidities are made large. In the case of the coating layer made of methyl phenyl silicone polymer as the base resin, the phenyl groups are randomly arranged in the cured polymer in order to avoid the steric interference between the phenyl groups, and hence the coating layer becomes very largely concave and convex in such a way that the portions of the coating layer with many phenyl groups are thick, but the portions with little phenyl groups are thin. This forms a striking contrast with the case of the methyl silicone polymer containing the crosslinking agent having the phenyl groups, and the coating layer made of the methyl phenyl silicone polymer cannot yield the effects similar to those mentioned above in the charge amount, fluidity, and the like.

Now, description will be made below on the aminosilane coupling agent which is used for the silicone based resins. The content ratio of the aminosilane coupling agent in the coating resin is preferably 14 to 18 wt %. When the content ratio of the aminosilane coupling agent is smaller than 14 wt %, the charging ability of the carrier tends to be insufficient in relation to the toner under high humidities owing to the too low amino group content. On the contrary, when the content ratio of the aminosilane coupling agent is larger than 18 wt %, the absolute charge amount is increased under low humidities, leading to the decreased image density. With the aminosilane coupling agent larger in content than necessary, the peeling off of the resin layer and the like occur, and the durability of the resin coating layer is not attained.

A general aminosilane coupling agent can be represented by the following formula:

[Chemical formula 8]

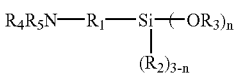

where $R_1$ is an alkylene group of 1 to 4 carbon atoms or a phenylene group, $R_2$ and $R_3$ are each an alkyl group of 1 to 2 carbon atoms, $R_4$ and $R_5$ are each a hydrogen atom, a methyl group, an ethyl group, a phenyl group, an aminomethyl group, an aminoethyl group or an aminophenyl group, n being 2 or 3.

The aminosilane coupling agent used in the present invention is represented by the following formula:

[Chemical formula 9]

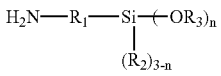

where $R_1$ is an alkylene group of 1 to 4 carbon atoms, $R_2$ and $R_3$ are each an alkyl group of 1 to 2 carbon atoms, n being 2 or 3. In other words, in the present invention the aminosilane coupling agent is a primary amine, since the coupling agent is the one represented by the general formula (formula (8)) with both $R_4$ and $R_5$ being hydrogen.

The secondary or tertiary amine, which is substituted with the methyl, ethyl, phenyl group, or the like, is so low in polarity that these amines do not have significant effect on the rise characteristic in charging in relation to the toner. When $R_4$ and $R_5$ are each an aminomethyl group, an aminoethyl group, or an aminophenyl group, the extreme tip of the silane coupling agent is a primary amine, and the amino groups in the straight chain organic groups extending from the silane make no contribution to the rise characteristic in charging in relation to the toner, but on the contrary, are affected by the humidity in a high humidity environment, leading to the decreased charging ability at the time of plate wear and eventually to a shortened life, although the charging ability in relation to the toner is initially maintained by the presence of the amino groups at the extreme tip. Examples include N-β-(aminoethyl)-Y-aminopropyl methyl dimethoxysilane and the like.

An alkylene group of 1 to 4 carbon atoms is used for $R_1$, and an alkyl group of 1 or 2 carbon atoms is used for each of $R_2$ and $R_3$, and in particular, a combination of $R_1$ of an alkylene group of 3 carbon atoms and $R_2$ and $R_3$ each of an alkyl group of 2 carbon atoms is most suitable. As $R_1$, an aliphatic alkylene group is more suitable in structure for the silicone based resins than a phenylene group, in particular for a methyl silicone based resin. As for $R_2$ and $R_3$, it is required that n=2 or greater and most preferably n=3, for the purpose of bringing the aminosiolane coupling agent into firm and intimate contact with the silicone based resin through the reaction with the base resin in the silicone based resin or the modified silicone based resin.

As the silicone based resin, the straight silicone resins based on the organosiloxane bond can be used. Commercial examples include KR-271 and KR-255 available from Shin-Etsu Chemical Co., Ltd., SR-2410, SR-2406, and SR-2411 available from Dow Corning Toray Silicone Co., Ltd., TSR-127B and TSR-144 available from Toshiba Silicones Co., Ltd., and the like. Catalysts may be added according to need. As the modified silicone resin, there can be used the silicone resins modified with the alkyd resin, polyester resin, epoxy resin, polyurethane resin, acryl resin and the like. Commercial examples include KR-206 (modified alkyd resin), KR-9706 (modified acryl resin), and ES-1001N (modified epoxy resin) available from Shin-Etsu Chemical Co., Ltd., SR-2101 (modified alkyd resin) available from Dow Corning Toray Silicone Co., Ltd., and the like. Among these, straight silicone resins are preferable, and in particular methyl silicone based resins are preferable in view of the coating strength. In the application method for the above mentioned silicone based resins, generally the silicone based resin is diluted with a solvent and applied onto the surface of the carrier core material. As the solvent for use in dilution, any solvent soluble in the above described silicone based resins can be used. Examples includes toluene, xylene, Cellosolve butyl acetate, methyl ethyl ketone, methyl isobutyl ketone, methanol, and the like. The method of applying the solvent diluted resin onto the surface of the carrier core material includes the impregnation method, spray method, brush application method, kneading method, and the like, and the solvent is volatilized after application. Other than these wet methods which use solvents, a dry method can be used in which the surface of the carrier core material is coated with the resin powder.

For the baking of the above described resins after application thereof onto the surface of the carrier core material, either an external heating method or an internal heating method can be used; examples include the baking using a stationary type or a flow type electric furnace, a rotary kiln type electric furnace, a burner furnace, and a microwave baking. The baking temperature is required to reach the temperature at which the crosslinking and curing proceed to a sufficient extent, depending on the type of the silicone based resin used.

After applying and baking the silicone based resin onto the surface of the carrier core material as described above, the carrier is cooled, pulverized, and controlled in particle size to yield the carrier coated with silicone based resin.

As for the carrier core material used in the present invention, an iron powder based carrier is preferable. This is because the clearance between the development sleeve and doctor blade in the cartridge of the present invention is as wide as 1.0 mm or above. Such a wide clearance allows for the cartridge to be rough in precision, leading to a merit of reducing the production cost. On the other hand, the ears of the developer become long and the carrier attachment tends to occur. In the cartridge, the rotational direction of the sleeve and that of the drum are made to be opposite to each other for the purpose of simplifying the gear arrangement of the rotational members and thereby reducing the cost. Consequently, the development system tends to provide large stress to the ears of the developer and hence tends to induce the carrier attachment. In such a development system, for example, the ferrite carrier, as described in Japanese Patent Publication No. 56-52305, is low in saturation magnetization, and the carrier attachment takes place when the particulate carrier is reduced in particle size, which constitutes a drawback that the photoreceptor and cleaning blade are scratched and the durabilities of these members are remarkably degraded. Accordingly, an iron powder based carrier having a stronger magnetic force is suitable for the present invention. At present, the practically used iron powder based carriers are generally classified into the following two types in view of the apparent shape. One is the carrier indefinite and irregular in shape, which is produced by firing the raw iron powder, and subsequently crushing and sizing thereof, as described in Japanese Patent Publication No. 55-40863. Thus, the obtained powder becomes an iron powder carrier indefinite in shape, and the ears of the developer becomes stiff owing to the high magnetic flux density in the development magnetic field ascribable to the shape anisotropy, and hence the solid portion (solid black portion) and the exfoliation portion (toner peeling off portion) tend to be formed. In addition, in the course of conveying the developer, the "fissure" and "deficiency" tend to occur, which damage the surface of the photoreceptor and eventually degrade the image quality. Furthermore, the fluidity of the developer is poor, and has a drawback that the developer deterioration is accelerated, and the torque exerted on the development roller becomes large in the process of conveying the developer. The other is the carrier generally referred to as the atomized iron powder which is a granular powder having a spherical or a nearly spherical shape, and is used preferably in the present invention. In this case, the carrier is nearly spherical in shape and accordingly free from the drawback of the irregular iron powder so that it acquires excellent characteristics. However, the spherical carrier is lower in specific surface area than the irregular shape carrier, and consequently the charge donating ability is decreased in the development using the developer based on the small sized particles as in the present invention. Thus, the specific surface area of the carrier is required to be as large as the specific surface area of the toner, so that the particle size of the carrier needs to be reduced. The carrier particle size appropriate to the toner of the present invention is preferably 80 μm or below. When the particle size of the toner is 40 μm or below, the fluidity becomes degraded, which becomes a cause for such inconveniences as the unsatisfactory charging, the increased toner spent, and the like. Thus, the preferable carrier particle size falls in the range from 40 to 80 μm in the weight average particle size. The true specific gravity of the carrier is preferably 6.0 or above for the purpose of optimizing the mixing and stirring property in relation to the specific gravity difference from the toner of the present invention. However, when the true specific gravity exceeds 8.0, the sliding friction force exerted on the drum is increased, which becomes a cause for inducing the image quality degradation. Thus, the preferable true specific gravity is 6.0 to 8.0.

The coating amount of the above described silicone based resin to the above described carrier core material is preferably 5.0 to 10.0 wt % in relation to the carrier core material. This is because the coating amount less than 5.0 wt % is insufficient to completely cover the carrier core material and hence degrades the durability of the carrier, while the coating amount larger than 10.0 wt % makes the carrier resistance to be too large to achieve the satisfactory development characteristics.

Furthermore, it is preferable that in the toner of the present invention, a magnetic fine powder is externally added to the toner particles, for the purpose of improving the charging stability in the low temperature and low humidity environment. This is intimately related with the characteristics of the carrier in the present invention. The carrier of the present invention is quick in the rise of charging owing to its excellent charging characteristics, always supplying a large amount of charge to the toner. This is because when the charge is stored and exceeds a certain amount, there occurs a problem that the image density is decreased due to charge-up. The addition of the magnetic fine powder to the surface of the toner particles as the developer reduces the surface resistance and the superfluous charge is leaked to always maintain an appropriate saturation charge. For that purpose, the magnetic fine powder is preferably used in 1 to 3 parts by weight in relation to 100 parts by weight of the toner. When the amount of the externally added magnetic fine powder is less than 1 part by weight, the toner surface resistance cannot be reduced effectively, while when it is larger than 3 parts by weight, there is a possibility that the magnetic fine powder causes a phenomenon of fusion and adhesion onto the drum surface.

The examples of the magnetic fine powders used for the toner of the present invention include the magnetic metal oxides containing such elements as iron, cobalt, nickel, copper, magnesium, manganese, aluminum, and silicon. The weight average particle sizes of these magnetic fine powders are preferably 0.05 to 0.30 μm. When the weight average particle size is smaller than 0.05 μm, an unpreferable degradation occurs in the polishing effect to always maintain the fresh surface of the OPC photoreceptor by scraping the surface to an appropriate extent. When the weight average particle size is larger than 0.3 μm, unpreferably the number of the magnetic fine powder particles is decreased and becomes insufficient to reduce the surface resistance of the toner particles by uniformly distributing, as the present invention does, the magnetic fine powder particles all over the toner particles. The shape of the magnetic fine particles composing the magnetic fine powder used in the present invention can be octahedral, hexahedral, and spherical.

Furthermore, in order to satisfy the object of the present invention at a high level, it is preferable that the magnetic fine particles composing the magnetic fine powder each have at least the aminosilane groups and the electric resistance of the magnetic fine powder is preferably $1\times10^3$ to $9\times10^3$. When the electric resistance is smaller than $1\times10^3$, the density of the aminosilane groups on the surface of the magnetic fine powder particles is extremely sparse, and the resistance to moisture is lowered so that the surface resistance tends to be affected by the environmental characteristics and the fogging and scattering tend to occur under the environment of high temperature and high humidity. When the electric resistance is larger than $9\times10^3$, the charge leak effect, which is relevant to the object of the present invention, is degraded.

The toner particles of the present invention contain waxes, and the waxes to be used include paraffin wax and the derivatives thereof, microcrystalline wax and the derivatives thereof, the Fischer-Tropsch wax and the derivatives thereof, polyolefin wax and the derivatives thereof, the Carnauba wax and the derivatives thereof, long chain carboxylic acids and the derivatives thereof, and long chain alcohols and the derivatives thereof. The derivatives include the oxides, the block copolymers of the vinyl based monomers and the waxes, and the graft modification substances between the vinyl based monomers and the waxes.

Among the waxes preferably used in the present invention, the polypropylene wax of low molecular weight (PP wax) is desirable, and it is preferable that the number average molecular weight (Mn) as measured with gel permeation chromatography (GPC) is 6000 to 8000.

In general, under the conventional condition of kneading, the kneading temperature, as measured immediately after the extrusion of the kneaded substance from the kneading machine, is an important parameter for recognizing the kneaded state. At the kneading temperature higher by 15 to 30° C. than the softening point of the PP wax, the dispersion property of the wax in the binder resin is satisfactory, and under such circumstances the wetting property between the binder resin and the magnetic fine powder also becomes satisfactory, which is favorable for achieving the object of the present invention.

The colorants used in the present invention are generally the dyes, pigments, carbon black, and the like; specifically the colorants include, for example, the dyes such as Nigrosine dye, carmine dye, various basic dyes, acidic dyes, oil dyes, anthraquinone dye, and the like; the benzidine based yellow organic pigment, quinantholine based organic pigment, rhodamine based organic pigment, and phthalocyanine based organic pigment; and zinc oxide, titanium oxide, and the like. Among these, the preferably used colorants are the carbon black colorants such as furnace black, acetylene black, thermal black, and the like. As for these carbon black colorants, the colorants of 15 to 30 nm in primary particle size and excellent in dispersion property are desirable, and moreover, the acidic (pH 7 or below) colorants which do not damage the other raw materials in production of the toner are desirable. Furthermore, since a magnetic fine powder is added to the toner of the present invention as a colorant component, the addition amount of carbon black can be small, and specifically 3 to 7 parts by weight of carbon black per 100 parts by weight of resin can exhibit its function satisfactorily.

Now, description will be made below on the binder resin used in the toner of the present invention. The binder resins used in the present invention include, for example, polystyrene; the monopolymers of styrene derivatives such as poly-p-chlorostyrene, polyvinylstyrene, and the like; the copolymers of styrene such as styrene-p-chlorostyrene copolymer, styrene-vinyltoluene copolymer, styrene-vinylnaphthalene copolymer, styrene-acrylic ester copolymer, styrene-methacrylic ester copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer; and poly (vinyl chloride), phenol resin, natural modified phenol resin, natural modified maleic acid resin, acrylic resin, methacrylic resin, poly(vinyl acetate), silicone resin, polyester resin, polyurethane, polyamide resin, furan resin, epoxy resin, xylene resin, polyvinylbutyral, terpene resin, cumarone indene resin, petroleum based resin, and the like. The crosslinked styrene based resins are also preferable binder resins.

The comonomers to be polymerized with styrene monomer to form the styrene based copolymers include monocarboxylic acids having double bond and the derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, acrylamide; dicarboxylic acids having double bond and the derivatives thereof such as maleic acid, butyl maleate, methyl maleate, dimethyl maleate, and the like; vinyl esters such as vinyl chloride, vinyl acetate, vinyl benzoate, and the like; ethylene based olefins such as ethylene, propylene, butylenes; vinyl ketones such as vinyl methyl ketone and vinyl hexyl ketone; and vinyl ethers such as vinyl methyl ether, vinyl ethyl ether, and vinyl isobutyl ether. These vinyl monomers are used each alone or in combination thereof as the styrene monomer. The crosslinking agents used are mainly those compounds which have each two or more than two polyerizable double bonds. Examples include aromatic divinyl compounds such as divinylbenzenes and divinylnaphtalenes; carboxylic acid esters having two double bonds such as ethylene glycol diacrylate, ethylene glycol dimethacrylate, and 1,3-butadiene dimethacrylate; divinyl compounds such as divinyl anilines, divinyl ether, divinyl sulfide, and divinyl sulfone; and compounds having three or more than three vinyl groups. These crosslinking agents are used each alone or in combination thereof.

The preferable styrene based resins are the ones which have the weight average molecular weight (Mw) of $15\times10^4$ to $25\times10^4$, the number average molecular weight (Mn) of $2\times10^3$ to $4\times10^3$, and the softening point of 145° C. to 165° C.

The toner of the present invention preferably comprises organometallic compounds as the charge controller. In particular, those organometallic compounds are useful which contain as ligands or counter ions those organic compounds that can be easily vaporized or sublimed. Examples of such organometallic compounds include the azo metal complexes represented by the following general formula:

[Chemical formula 10]

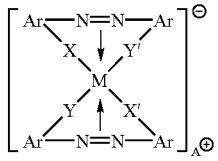

where M stands for the central coordination metal such as Cr, Co, Ni, Mn, Fe, or the like; Ar stands for an aryl group or a naphthyl group; X, X', Y, and Y' each stand for O, CO, NH, or NR where R is an alkyl group of 1 to 4 carbon atoms; and A stands for hydrogen, sodium, potassium, ammonia, or an aliphatic ammonium. It is preferable to use those charge controllers which have Cr as the central metal, among these azo metal complexes.

It is preferable to add the charge controller in the range from 0.5 to 3 parts by weight in relation to 100 parts by weight of the toner. It is preferable to externally add an inorganic fine powder to the toner particles for the purpose of improving the charging stability, development property, fluidity, and durability. This is intimately related to the constitution of the drum cartridge in the present invention. In a conventional drum cartridge, the toner recovered by a cleaning member is recovered by its own weight in the gravitational direction opposite to that on the photoreceptor drum and recovered in a box by a spiral member or the like. The drum cartridge of the present invention has a downsized cleaning space according to the recent downsizing trend. As a result, the drum cartridge has a structure in which the toner recovered by the cleaning member is recovered in the box, while being pressure welded on the photoreceptor drum. Accordingly, the magnetic fine powder is more remarkably fused and adheres to the drum. In order to overcome these inconveniences, it is necessary to improve the fluidity of the toner itself for reduction of the friction coefficient in relation to the drum. Thus, according to the structure of the drum cartridge in the present invention, the inorganic powder is externally added in a larger amount than usual so that the above described inconveniences are prevented. However, such a fine powder usually has a strong negative electrification property, so that an excess addition of the external additive causes the charge-up of the toner as a whole, which makes a factor causing the image density degradation. Thus, it is recommended that the addition amount of the inorganic fine powder is made to fall in the range from 0.3 to 1 part by weight in relation to 100 parts by weight of the toner.

Examples of the inorganic fine powers include the silica fine powder, titanium oxide fine powder, alumina fine powder, and the like. In particular, those inorganic fine powders which have the specific surface area of 90 to 150 $m^2/g$ as measured with the BET method through nitrogen adsorption give satisfactory results. It is also preferable that the inorganic fine powders are treated, for the purpose of being made hydrophobic and controlling the electrification property, according to need with such treating agents as silicone varnish, various modified silicone varnishes, silicone oil, various modified silicone oils, silane coupling agents, silane coupling agents having functional groups, and other organosilicon compounds. Two or more treating agents may be used. In particular, the silica fine powder subjected to the surface treatment with silicone oil is preferable.

As the other additives, there are suitably used such lubricants as Teflon (registered trademark), zinc stearate, poly(vinylidene fluoride), and silicone oil powder (containing about 40% of silica). In addition, there are preferably used such polishing agents as cerium oxide, silicon carbide, calcium titanate, and strontium titanate, and among these agents, strontium titanate is preferable. As development property improver, there may be used small amounts of anti-caking agents; conductivity donating agents such as carbon black, zinc oxide, antimony oxide, and tin oxide; and white fine granular powders and black fine granular powders both being opposite in polarity to the toner particles.

Description will be made below on the production method of the toner particles. As for the kneading machine used in the present invention, the kneading with an extruder is preferable according to the recent mass production of toner. In particular, the preferable extruder is a biaxial extruder from the view point of the product quality stability and mass productivity. Specifically, examples include the TEM-100B extruder (Toshiba-machine Co., Ltd.), PCM-87 extruder (Ikegai Tekko Co.), and the like.

In the fusing and kneading process for producing toner, the mixture containing at least the binder resin, magnetic fine powder, and wax, is kneaded with a kneading machine under the following conditions:

Kneading temperature: the softening point temperature of the resin and wax +15° C. to 30° C.

Revolution speed: 150 to 210 rpm

Feed rate: 80 to 140 kg/hr

By means of the conventional methods, the kneaded substance obtained is cooled by rolling, cracked, pulverized by jet stream, and sized, to yield the toner particles.

Description will be made below on an example of the image forming methods which use the developer for use in electrophotography of the present invention.

By applying the voltage with a charger, the surface of the electrostatic image holding member (photoreceptor drum) is charged with negative polarity, the digital latent image is formed by image scanning with exposure using laser light, and the latent image is reversely developed with the toner on the development unit equipped with the toner supporting member (development sleeve) incorporating a doctor blade and a magnet. In the development unit, the conductive base of the photoreceptor drum 2 is grounded, and a bias voltage applying device applies a DC bias voltage to the development sleeve. A sheet of transfer paper is delivered and reaches the transfer unit where, by charging from the back surface (opposite to the photoreceptor drum) of the sheet of transfer paper using a roller transfer device with a voltage applying device, the developed image (toner image) on the surface of the photoreceptor drum is transferred to the sheet of transfer paper through the transfer charge. The sheet of transfer paper separated from the photoreceptor drum undergoes the fixing treatment by use of a hot pressing roller fixing unit for the purpose of fixing the toner image on the sheet of transfer paper.

The toner persisting on the photoreceptor drum after the transfer process is recovered in the recovery box through cleaning with an elastic blade. The photoreceptor drum after cleaning by the cleaning device undergoes again the process starting with the charging process with the charging device.

The photoreceptor drum comprises a photoreceptor layer and a conductive base. A nonmagnetic cylinder of development sleeve, which is the toner support, rotates in the development unit in the direction opposite to the direction of the surface of the photoreceptor drum. In the interior of the development sleeve, a multipolar permanent magnetic (magnet roll) is arranged as a magnetic field generating device in such a manner that it does not rotate. The toner and the developer in the development unit are applied onto the nonmagnetic cylinder, and the toner is given, for example, a negative tribocharge through the friction with the carrier.

In the development unit, a DC bias may be applied to the development sleeve by means of a bias device. The DC bias is satisfactorily −400 to −500 V.

In the transfer of the toner in the development unit, the toner is transferred to the electrostatic image by the electrostatic action of the surface of the photoreceptor device and the action of the bias.

The photoreceptor drum comprises, as the fundamental constituting layers, a conductive base layer formed of a conductive metal such as aluminum and a photoconductive layer formed on the outer surface thereof, and the drum is rotated at the prescribed peripheral velocity (process speed). The surface of the photoreceptor drum is charged in a prescribed polarity and a potential by the electrification charger. Then, the image exposure forms the electrostatic image, which is sequentially visualized as the toner image by means of the developing device.

Description will be made below on the image forming apparatus of the present invention with reference to FIG. 1. The image forming apparatus is equipped with a charging device 1, a photoreceptor drum 2, an image transfer device 3, a development sleeve 4, and a fixing device 5, and has a process cartridge. The process cartridge is a device in which at least a development device and a latent image holding member are separately formed each in a cartridge, and which is constituted so as to be removable from the main body of an image forming device (for example, a copying machine, a laser beam printer, a facsimile device).

FIG. 1 shows a process cartridge which integrates a development device, a drum shaped electrostatic image holding member (photoreceptor drum), a cleaning device equipped with a cleaning blade, and an electrification charger as a primary charging device.

In the present invention, the development device has a doctor blade as a device for controlling the developer layer thickness and a toner container being charged with the toner. By using the toner, the development process is performed through the prescribed electric field, formed at the time of development by the development bias voltage supplied by a bias applying device, between the photoreceptor drum and the development sleeve as the toner support. In order to suitably perform the development process, the distance between the photoreceptor drum and the development sleeve is adjusted.

The above description is made on the embodiment in which the four constituent elements, that is, the development device, latent image holding member, cleaning device, and primary charging device, are integrated in a cartridge form. However, in the present invention, the development device and the electrostatic image holding member may be separately formed each in a cartridge.

More specific description will be made below on the present invention on the basis of the examples.

Now, Example 1 is described.

Carrier (i) Core material: atomized iron powder (Kanto Denka Kogyo Co., Ltd.)
  (a) Average particle size: 60 μm
  (b) True specific gravity: 7.0
(ii) Coating resin: silicone based resin (brand name: SR-2411, solid content 20 wt %, Dow Corning Toray Silicone Co., Ltd.)
  (a) Coating amount: 7.5 wt %
(iii) Additive 1
  (a) Phenyl crosslinking agent (trimethoxyphenylsilane)
  (b) Addition amount: the total number of the phenyl groups is 3% by number in relation to the total functional groups R in the whole silicone resin
(iv) Additive 2
  (a) Aminosilane coupling agent (Y-aminopropyl methyl dimethoxysilane)
  (b) Addition amount: 10 wt %

The silicone resin was mixed with Y-aminopropyl methyl dimethoxysilane of 8 wt % in relation to the solid content of a silicone based resin (brand name: SR-2411, solid content 20 wt %, Dow Corning Toray Silicone Co., Ltd.) containing the phenyl crosslinking agent (trimethoxyphenylsilane), with the total number of the phenyl groups being adjusted to be 3% by number in relation to the total functional groups R in the whole silicone resin. The mixture was dissolved in toluene, and then applied, by means of a fluid bed, to coat the carrier core material in 0.7 wt % in relation to the carrier core material. Then, the carrier core thus treated was baked for 2 hours to yield the carrier coated with the above mentioned resin.

Toner (i) Binder resin: 100 parts by weight
  (a) Styrene—n-butyl acrylate copolymer (copolymerization weight ratio=80:20)
  (b) Weight average molecular weight (Mw): 200,000 Number average molecular weight (Mn): 3,000
  (c) Softening point: 155° C.
  (d) Acid number: 0.2 KOH mg/mg
  (e) Residual monomer amount: 500 ppm
(ii) Magnetic fine powder: 3 parts by weight
  (a) Weight average particle size R: 0.20 μm
  (b) Shape of the magnetic fine powder: octahedron
(iii) Negative charge controller: 1.5 parts by weight
  (a) Monoazo complex represented by the above formula (a)
  (b) Primary particle size: 7 μm
(iv) Wax: 2 parts by weight
  (a) Low molecular weight polypropylene
  (b) Softening point: 155° C.
  (c) Measurement method of softening point: DSC endothermic peak temperature
(v) Carbon black: 6 parts by weight
  (a) pH: 3
  (b) Primary particle size: 30 μm The above materials were mixed together with a Henschel mixer to obtain a mixture, the obtained mixture was introduced into a biaxial extruder (brand name "PCM-65", Ikegai Tekko Co.), where the mixture was fused and kneaded with the screw revolution speed of 180 (rpm), the preset temperature of 100° C., and the mixture feed rate of 110 kg/hr. The temperature of the kneaded substance was 180° C. immediately after being kneaded. The kneaded substance was cracked with a hammer mill to a powder of 1 mm or below in size, the cracked substance obtained was pulverized with an impact airstream pulverizer using jet stream to obtain a pulverized powder. The weight average particle size (D50) of the toner particles was 8.2 μm.

The obtained particulate toner of 100 parts by weight was mixed with 0.55 part by weight of the hydrophobic silica fine powder (BET specific surface area: 120 $m^2/g$) subjected to surface treatment with the silane coupling agent and dimethyl silicone oil and 2.0 parts by weight of magnetite having aminosilane groups, to prepare a toner capable of being negatively friction charged.

For the purpose of performance evaluation of the toner on the basis of the image forming method shown in the attached figure, the toner was introduced into the development unit in the process cartridge for use in a laser beam printer (brand name AR-270, fixing temperature 180° C., Sharp Co., Ltd.) capable of developing the electrostatic image on the basis of the reverse development method with image resolution of 1200 dpi, the process cartridge was set in the printer, and the image printing test was performed under various conditions.

The performance evaluation results are shown in FIG. 2.

The performance evaluation method will be described below.

(a) Image Density

The densities of the solid black images on the early sheet (2nd sheet) and the 200,000th sheet of transfer paper were measured by means of a Macbeth densitometer. The original document carrying an image of a black solid circle of 55 mm in diameter was used, and the image printing was repeated three times. The solid black portion on the three sheets of the printed sample paper was subjected to the density measurement on the Macbeth densitometer, and the obtained densites were averaged to yield the density for performance evaluation.

The performance evaluation standards are as follows:

5: 1.4 or above

4: 1.3 to 1.4

3: 1.2 to 1.3

2: 1.0 to 1.2

1: 1.0 or below (b) Fogging

The whiteness of the transfer paper before printing was beforehand measured with a "whiteness meter" (Hunter whiteness meter, Nippon Denshoku Industries, Co., Ltd.), and compared with the whiteness of the printed white image portion to obtain the whiteness difference. The whiteness for performance evaluation was the possible maximum difference of the differences thus obtained. The measurement method of fogging density was as follows: the whiteness of a sheet of A4 size white paper was beforehand measured on a whiteness meter (Hunter whiteness meter, Nippon Denshoku Kogyo, Co.) to give the whiteness to be referred to as the first measured value. Then, using an original document carrying a white circle of 55 mm in diameter, copying was repeated three times and the whiteness of the white portion on each copied sample was measured with the above mentioned whiteness meter, the resulting average value being referred to as the second measured value. The fogging value was defined as the value obtained by subtracting the second measured value from the first measured value.

The performance evaluation standards are as follows:

5: 0.4 or below

4: 0.6 to 0.4

3: 0.8 to 0.6

2: 1.0 to 0.8

1: 1.0 or above (c) Dotted Image of 1200 dpi

Under the image printing conditions that permit the formation of a dotted latent image of 600 dots per inch, a one-dot toner image was formed and the toner image was enlarged and the image quality was evaluated by visual inspection in the following 5 grades.

5: Excellent

4: good

3: fair

2: fairly poor

1: poor (where toner scattering or dot image deformation is observed)

(d) Environmental Variation of Charging

The difference between the charged amount ($Q_{LL}$) obtained for the developer stored for 24 hours under the conditions of the temperature of 5° C. and the humidity of 15% and the charged amount ($Q_{HH}$) obtained for the developer stored for 24 hours under the conditions of the temperature of 35° C. and the humidity of 85%, $\Delta Q = Q_{LL} - Q_{HH}$ (μc/g), was subject to ranking to evaluate the environmental variation of the charged amount as follows.

5: ΔQ is smaller than or equal to 3 μc/g.

4: ΔQ is larger than 3 μc/g and smaller than or equal to 5 μc/g.

3: ΔQ is larger than 5 μc/g and smaller than or equal to 7 μc/g.

2: ΔQ is larger than 7 μc/g and smaller than or equal to 12 μc/g.

1: ΔQ is larger than 12 μc/g.

The measurement of the charged amounts was made with an apparatus E-SPART ANALYZER made by Hosokawa Micron Co. or on another equivalent apparatus.

(e) Rise Characteristics of Charging

The developer newly fed with the toner was stirred and mixed in the development unit, and the charge donating rate to the fed toner was obtained from the charge variation and ranked to evaluate the rise characteristics of charging.

5: Excellent level in evaluation of rise characteristics of charging

4: Satisfactory level in evaluation of rise characteristics of charging

3: Practically usable level in evaluation of rise characteristics of charging

2: Problematical and unusable level in evaluation of rise characteristics of charging 1: Practically unusable level in evaluation of rise characteristics of charging The overall performance evaluation was obtained by averaging the above described various performance evaluations.

FIG. 2 also shows the various conditions and performance evaluation results for the other examples.

Examples 1 to 5 are the examples of the developers for use in electrophotography wherein the toner contains a magnetic powder as external additive, the carrier is a resin coated magnetic carrier of 6.0 to 8.0 in true density, and the coating resin is a silicone based resin containing a crosslinking agent having phenyl groups and an aminosilane coupling agent.

Examples 6 to 9 are the examples of the developers for use in electrophotography wherein the crosslinking agent in the coating resin for the carrier has a phenyl content ratio of 0.2 to 15% by number.

Examples 10 to 13 are the examples of the developers for use in electrophotography wherein the coating resin for the carrier has a content ratio of the aminosilane coupling agent ranging from 5 to 20 wt %.

Examples 14 to 17 are the examples of the developers for use in electrophotography wherein the coating amount of the silicone based resin for the carrier core material is 7.0 to 8.0 wt % in relation to the carrier core material.

Examples 18 to 21 are the examples of the developers for use in electrophotography wherein the 50% average particle size based on volume of the magnetic carrier coated with the coating resin is 40 to 80 μm.

Examples 22 to 25 are the examples of the developers for use in electrophotography wherein the toner is mixed with a magnetic fine powder as external additive, and the magnetic fine powder is octahedral in shape and contains at least 1 to 3 wt % of magnetite having at least the aminosilane groups on the surface thereof.

As described above with reference to Examples and the like, by use of the two-component developer which comprises the toner containing at least a magnetic fine powder as external additive and the carrier wherein the coating resin is a silicone based resin containing a crosslinking agent having phenyl groups and an aminosilane coupling agent, there can be obtained a developer comprising those durable carrier and toner which are excellent in environmental stability, capable of instantly donating the charging ability to the toner fed at the time of plate wear, and capable of maintaining the appropriate saturation charge amount for a long period of time.

According to the present invention, there can be obtained a developer for use in electrophotography and a method and an apparatus for image formation which developer has a high development ability, prevents effectively so-called toner spent in which the toner film is formed on the carrier surface, and comprises the carrier so durable that the excellent characteristics thereof is not damaged for use over a long period of time and the toner capable of maintaining the excellent characteristics thereof for a long period of time in various environments owing to the combination thereof with the carrier.

What is claimed is:

1. A two-component developer comprising a toner and a carrier for use in electrophotography, wherein said toner contains a magnetic powder as an external additive, said carrier is a resin coated magnetic carrier of 6.0 to 8.0 in true specific gravity, and the coating resin is a silicone based resin containing a crosslinking agent having a phenyl group and an aminosilane coupling agent, wherein the toner is mixed with a magnetic fine powder as an external additive, said magnetic fine powder is octahedral in shape and contains 1 to 3 wt % of magnetite having aminosilane groups on the surface thereof, the coating resin of said carrier has a content ratio of the aminosilane coupling agent ranging from 14 to 18 wt %, and a 50% average particle size based on volume of the magnetic carrier coated with the coating resin is 40 to 80 μm.

2. The developer for use in electrophotography according to claim 1, wherein a coating amount of the silicone based resin for the carrier core material is 7.0 to 8.0 wt % in relation to the carrier core material.

3. A method for image formation, the method comprising the step of reversely developing a latent image with a two-component developer comprising a toner and a carrier for use in electrophotography, wherein said toner contains a magnetic powder as an external additive, said carrier is a resin coated magnetic carrier of 6.0 to 8.0 in true specific gravity, and the coating resin is a silicone based resin containing a crosslinking agent having a phenyl group and an aminosilane coupling agent, wherein the toner is mixed with a magnetic fine powder as an external additive, said magnetic fine powder is octahedral in shape and contains 1 to 3 wt % of magnetite having aminosilane groups on the surface thereof, the coating resin of said carrier has a content ratio of the aminosilane coupling agent ranging from 14 to 18 wt %, and a 50% average particle size based on volume of the magnetic carrier coated with the coating resin is 40 to 80 μm.

4. The method for image formation of claim 3, wherein a coating amount of silicone based resin for the core carrier materials is 7.0 to 8.0 wt % in ratio to the core carrier material.

5. A two-component developer comprising a toner and a carrier for use in electrophotography, wherein said toner contains a magnetic powder as an external additive, said carrier is a resin coated magnetic carrier of 6.0 to 8.0 in true specific gravity, and the coating resin is a silicone based resin containing a crosslinking agent having a phenyl group and an aminosilane coupling agent, wherein the toner is mixed with a magnetic fine powder as an external additive, said magnetic fine powder is octahedral in shape and contains 1 to 3 wt % of magnetite having aminosilane groups on the surface thereof, the coating resin of said carrier has a content ratio of the aminosilane coupling agent ranging from 14 to 18 wt %, and a 50% average particle size based on volume of the magnetic carrier coated with the coating resin is 40 to 80 μm;

wherein the crosslinking agent of the silicone based resin is represented by at least one of the following structural formulas, in which R represents a phenyl group, or derivatives thereof:

(1) An alcohol elimination type crosslinking agent:

$$R\text{–}Si(OCH_3)_3$$

(2) An acetic acid elimination type crosslinking agent:

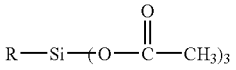

(3) An oxime elimination type crosslinking agent:

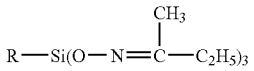

(4) An amido elimination type crosslinking agent:

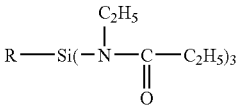

or (5) An acetone elimination type crosslinking agent:

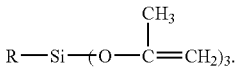

6. The developer for use in electrophotography according to claim 5, wherein a coating amount of the silicone based resin for the carrier core material is 7.0 to 8.0 wt % in relation to the carrier core material.

* * * * *